US007214085B2

(12) United States Patent
Ohtaka et al.

(10) Patent No.: US 7,214,085 B2
(45) Date of Patent: May 8, 2007

(54) CONNECTOR

(75) Inventors: Kazuto Ohtaka, Shizuoka (JP); Masashi Tateishi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/269,619

(22) Filed: Nov. 9, 2005

(65) Prior Publication Data

US 2006/0134964 A1 Jun. 22, 2006

(30) Foreign Application Priority Data

Dec. 22, 2004 (JP) ..... 2004-370501

(51) Int. Cl.
*H01R 13/627* (2006.01)

(52) U.S. Cl. ..... 439/352

(58) Field of Classification Search ..... 439/352, 439/358, 357, 347, 489
See application file for complete search history.

(56) References Cited

U.S. PATENT DOCUMENTS 4,634,204 A * 1/1987 Detter et al. ..... 439/347
5,938,470 A * 8/1999 Kashiyama ..... 439/489
6,116,939 A * 9/2000 Fukuda ..... 439/354
6,439,915 B2 * 8/2002 Kurimoto ..... 439/352

FOREIGN PATENT DOCUMENTS

JP 11-31554 2/1999

* cited by examiner

*Primary Examiner*—Alexander Gilman
(74) *Attorney, Agent, or Firm*—Armstrong, Kratz, Quintos, Hanson & Brooks, LLP

(57) ABSTRACT

The present invention is to provide a cantilever structure connector without an extended portion of a main locking arm and provide also a locking feeling similar to that of a center impeller structure connector. When a male and female housings are connected to each other, rib protrusions disposed at inner walls of ribs abut to side protrusions and parts of side locking arms enter into between the main locking arms and the male housing. Accordingly, the main locking arms become temporarily a center impeller structure. When a center protrusion abuts to main protrusions, the main protrusions are subjected to a large downward force, or a large upward repulsive force.

6 Claims, 5 Drawing Sheets

CONNECTOR

BACKGROUND OF THE INVENTION

1. Field of the Invention

The present invention relates to a connector having a male housing and female housing and specifically to a connector providing an improved locking feeling with a locking arm of a cantilever structure.

2. Description of the Related Art

FIG. 9 is a perspective view of a conventional connector. FIG. 10 is a drawing to explain an operation and problem of the conventional connector.

As shown in FIG. 9, a box-shaped male housing 8 includes a main locking arm 81 having a center impeller structure, a pair of guide ribs 82 upstanding to the right and left of the main locking arm 81, a protrusion 81*a* on the main locking arm 81, and a depressing portion 81*b* having a square button shape and disposed at one end of the main locking arm 81. A female housing 9 includes a box-shaped receptacle 93 with an inner periphery being same as an outer periphery of the male housing 8, a pair of guide grooves 92 in accord with the pair of guide ribs 82, and a notch 91*b* in accord with the depressing portion 81*b*.

In order to connect the male and female housings 8 and 9, the guide ribs 82 and the guide grooves 92 are aligned each other and the male housing 8 is inserted into the female housing 9, in an arrow direction in FIG. 9, while depressing the depressing portion 81*b* and deforming an upper portion of the main locking arm 81. The protrusion 81*a* on the main locking arm 81 abuts to a hood of the female housing 9 during connecting. When the protrusion 81*a* enters into a hole, not shown, the main locking arm 81 resumes an initial shape and the connection is completed. Electric wires 84 and 94 connected to the male and female housings 8 and 9, respectively, are also electrically connected.

JP, H11-31554,A discloses a prior art related to the present invention.

In this kind of connectors, a locking feeling to assure the complete connection between the male and female housings 8 and 9 is important. Without the locking feeling, a worker has concerns about the connection and tries again. This causes a low working efficiency. For this reason, the main locking arm 81 has a center impeller structure 81*c* and 81*d* as shown in FIG. 10. The center impeller structure gives a relatively large reaction force, or an upward force in FIG. 10, to the main locking arm 81 and attains a moderate locking feeling.

Meanwhile, an arrangement of the depressing portion 81*b* becomes difficult. If the depressing portion 81*b* is disposed at apart by L from a rear end of the main locking arm 81, a portion having the depth L extends outside the male housing 8. If the male housing 8 extends to the rear end of the main locking arm 81 to include this extension, the male housing 8 becomes a large size.

Although the center impeller structure gives the suitable locking feeling and the large repulsive force, it becomes difficult to unlock the male and female housings 8 and 9.

The center impeller structure requires the extension L outside the depressing portion 81*b* as shown in FIGS. 9 and 10, and causes the difficulty of unlocking.

SUMMARY OF THE INVENTION

An object of the present invention is to provide a connector having a cantilever structure and giving a locking feeling similar to a center impeller structure without an extension of a main locking arm so that the connection and disconnection of a male housing and female housing become easy.

According to a first aspect of the present invention, a connector having a male housing and female housing, comprising a main locking arm disposed in one of the male housing and the female housing, the main locking arm having a cantilever structure and being flexible in a vertical direction; a side locking arm disposed to a side of the main locking arm, the side locking arm being flexible in a lateral direction to be sandwiched between the main locking arm and the one housing; a main locking portion disposed on the main locking arm; a side locking portion disposed on the side locking arm; a rib upstanding in the other housing; a rib engaging portion disposed in the rib, the rib engaging portion abutting to the side locking portion to sandwich a part of the side locking arm between the main locking arm and the one housing and lock the side locking portion after sandwiching when the male and female housings being connected to each other; a center engaging portion disposed on a plate of the other housing, the center engaging portion abutting and pressing the main locking portion when the male and female housings being connected to each other and the part of the side locking arm being sandwiched between the main locking arm and the one housing.

Thereby, when the male housing is inserted into the female housing, the rib engaging portion abuts to the side locking portion and depresses the side locking arm and pushes a part thereof into between the main locking arm and the one housing. Then, the center engaging portion abuts to the main locking portion. Since the part of the side locking arm is sandwiched between the main locking arm and the one housing, the main locking arm is bent in a bow shape. At this moment, the main locking arm having the cantilever structure becomes a center impeller structure and the main locking portion is depressed with a large force downwardly so that a large upward repulsive force is generated and gives a suitable locking feeling.

According to a second aspect of the present invention, the center engaging portion is locked with the main locking portion at the same time when the part of the side locking arm is released from sandwiching.

According to a third aspect of the present invention, the main locking arm has a depressing portion at an end thereof, the depressing portion disconnects locking between the main locking portion and the center engaging portion, and depresses downwardly the end of the main locking arm after disconnection while preventing the part of the side locking arm from being sandwiched between the main locking arm and the one housing.

Thereby, when the depressing portion is depressed downwardly, the main locking portion is unlocked from the center engaging portion without interference of the side locking arm. The main locking portion and the center engaging portion are unlocked from each other by applying a force equivalent to the cantilever structure. After unlocking, the side locking arm abuts to the side of the main locking arm and can not enter underneath the main locking arm. Although the side locking arm is curved toward the main locking arm it does not give any difficulty for disconnecting each housing.

According to a fourth aspect of the present invention, the side locking arms are formed in a pair, the side locking portions are disposed at outer faces of the pair of the side locking arms, the ribs are upstanding opposedly, and the rib engaging portions extend out of inner faces of the ribs corresponding to the side locking portions.

Thereby, the side locking arms and the side locking portions, and the ribs and the rib engaging portions provide a stable connection between the male and female housings.

According to a fifth aspect of the present invention, the main locking arms have a guide slit in a longitudinal direction thereof, and the other housing has an upstanding guide rib corresponding to the guide slit.

Thereby, they provide a stable connection between the male and female housings. They also give an easy connection and disconnection.

According to a sixth aspect of the present invention, a connector having a male housing and female housing, comprising a main locking arm disposed in one of the male housing and the female housing, the main locking arm having a cantilever structure and being flexible in a vertical direction; a side locking arm disposed to a side of the main locking arm, the side locking arm being flexible in a lateral direction; and a rib upstanding in the other housing, whereby, when the male and female housings are connected to each other, the side locking arm contacts with the rib and allows a part of the side locking arm to be sandwiched between the main locking arm and the one housing, and a part of the main locking arm contacts with the other housing so that the main locking arm is depressed.

Thereby, the main locking arm having the cantilever structure operates temporarily as a center impeller structure.

DETAILED DESCRIPTION OF THE PREFERRED EMBODIMENTS

Figure 2A:
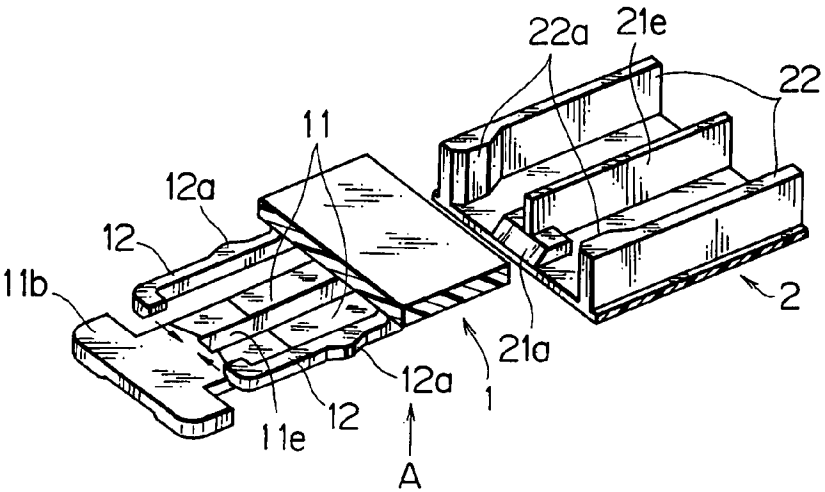
FIG. 2A is a perspective view showing a main portion of the connector of FIG. 1.
Figure 2B:
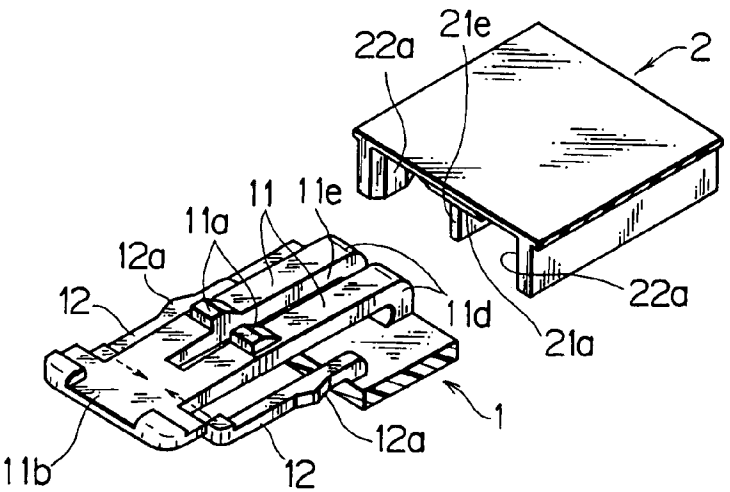
FIG. 2B is a perspective view showing the main portion viewed from a direction A in FIG. 2A.
Figure 1:
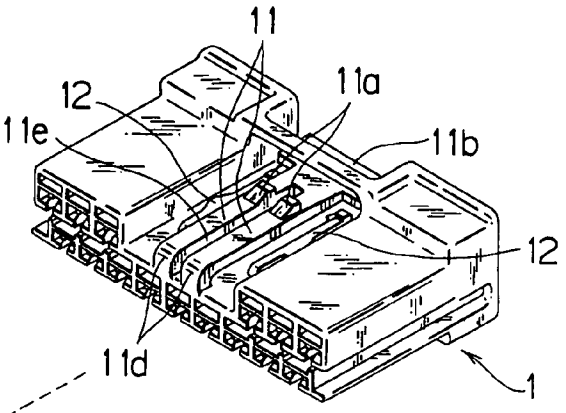
FIG. 1 is a perspective view showing an embodiment of a connector of the present invention.
Figure 1:
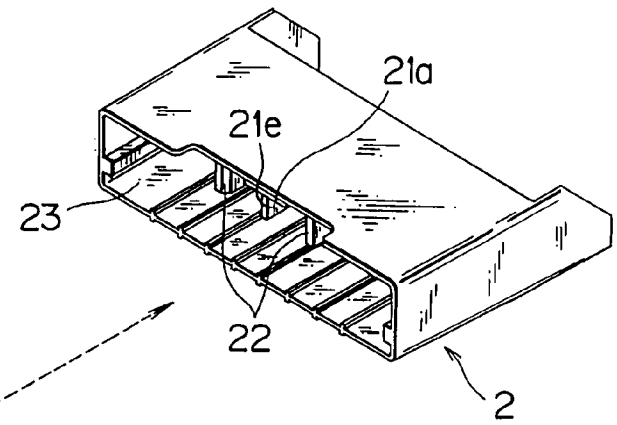
Figure 3:
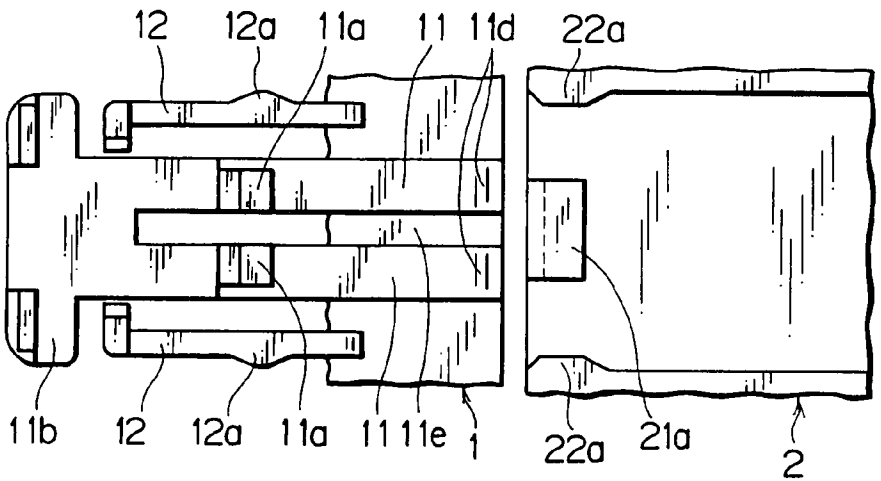
FIG. 3 is a top view of the main portion of the connector of FIG. 2B.

Embodiments of the present invention are explained by referring to drawings. FIG. 1 is a perspective view of an embodiment of a connector of the present invention. FIG. 2A is a perspective view of a main part of the connector of FIG. 1. FIG. 2B is a perspective view of FIG. 2A viewed from a direction of A in FIG. 2A. FIG. 3 is a top view of FIG. 2B. Guide ribs are omitted in FIG. 3.

As shown in FIG. 1, the connector includes a male housing 1 and female housing 2, made of a synthetic resin, each having pin terminals, not shown, connecting a plurality of electric wires.

The male housing 1 is box-shaped and has main locking arms 11 with cantilever structure and side locking arms 12 disposed at both sides of the main locking arms 11. The main locking arms 11 are connected to the male housing 1 through supporters 11*d* and have main protrusions (main locking portions) 11*a* thereon, a depressing portion 11*b* at an end thereof, and a guide slit 11*e*.

The female housing 2 is box-shaped and has a receptacle 23 with an inner periphery same as an outer periphery of the male housing 1. The female housing 2 has a pair of ribs 22 corresponding to the side locking arms 12, a center protrusion (center engaging portion) 21*a* to be locked with the main protrusions (main locking portions) 11*a*, and an upstanding guide rib 21*e* corresponding to the guide slit 11*e*.

FIGS. 2A, 2B and 3 show detailed structures of the male housing 1 and the female housing 2. The male housing 1 has the main locking arms 11 supported with the supporters 11*d*. The main locking arms 11 are flexible in the vertical direction and have the depressing portion 11*b* for depressing the end of the main locking arms 11 downwardly. The depressing portion 11*b* is wider than other portions.

The depressing portion 11*b* unlocks locking between the main protrusions 11*a* and the center protrusion (center engaging portion) 21*a* and prevents parts of side locking arms 12 from entering into between the main locking arms 11 and the male housing 1. The guide slit 11*e* is disposed at the center of the main locking arms 11 along the longitudinal direction. The main locking arms 11 are joined to the depressing portion 11*b* and each has the main protrusion 11*a* with a trapezoid-section thereon.

The male housing 1 has the pair of the side locking arms 12 at the both sides thereof. Each side locking arm 12 is also a cantilever structure supported with the male housing 1 and flexible in a lateral direction. The height of the side locking arms 12 is shorter than that of the main locking arms 11 so that the parts, for example, heads, of the side locking arms 12 deformed opposed can enter into between the main locking arms 11 and the male housing 1 and limit downward bending of the main locking arms 11 when the both housing are connected to each other. Each side locking arm 12 has a hill-shaped side protrusion (side locking portion) 12*a* at an outer surface thereof, the detail of which is described later.

The upwardly extending ribs 22 opposed to each other, corresponding to the side locking arms 12, are disposed on the female housing 2. Each rib 22 has a hill-shaped rib protrusion (rib engaging portion) 22*a* at an inner wall thereof and the rib protrusions 22*a* are opposed to each other and the center protrusion 21*a* with a trapezoid section is disposed midway between the rib protrusions 22*a*. The guide rib 21*e* corresponding to the guide slit 11*e* extends upwardly on the housing surface and a part thereof covers the center protrusion 21*a*.

When the male housing 1 and the female housing 2 are fitted to each other, the rib protrusions (rib engaging portions) 22*a* abut to the side protrusions 12*a* and push parts of the side locking arms 12 into between the lower face of the main locking arms 11 and the male housing 1. After abutting, the side locking arms 12 return to an initial position so that the rib protrusions 22*a* lock the side protrusions (side locking portions) 12*a*. When the male housing 1 and female housing 2 start to be fitted to each other and the parts of the side locking arms 12 enter into between the main locking arms 11 and the male housing 1, the center protrusion 21*a* presses downwardly the main protrusions 11*a*. When the side locking arms 12 return to the initial position with further fitting of the housings, the center protrusion 21*a* locks the main protrusions 11*a*.

An operation and effect of the connector are explained in FIGS. 4 to 7. FIGS. 4A and 4B are a front and sectional views prior to the male and female housing being connected to each other, respectively. FIGS. 5A and 5B are a front and sectional views while the male and female housing are being connected to each other, respectively. FIGS. 6A and 6B are a front and sectional views after the male and female housing are connected to each other, respectively. FIGS. 7A and 7B are a front and sectional views during disconnection of the male and female housings.

Figure 4B:
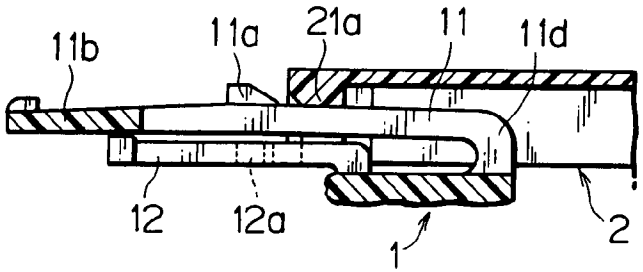
FIG. 4B is a sectional view of the male housing and female housing prior to connection to each other.
Figure 4A:
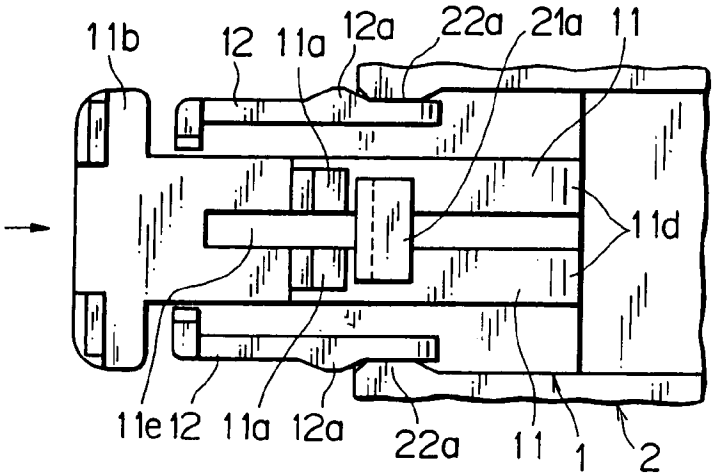
FIG. 4A is a front view of a male housing and female housing prior to connection to each other.

Prior to the male and female housings 1 and 2 being connected to each other the guide slit 11*e*, the guide rib 21*e*, the side locking arms 12, and the ribs 22 are positioned and the male housing 1 is inserted into the female housing 2 in a direction of an arrow shown in FIG. 4A. As shown in FIGS. 4A and 4B, at this state, the main protrusions 11*a* do not contact with the center protrusion 21*a* and the side protrusions 12*a* do not contact with the rib protrusions 22*a*. The main locking arms 11 and the side locking arms 12 are not deformed yet.

Figure 5B:
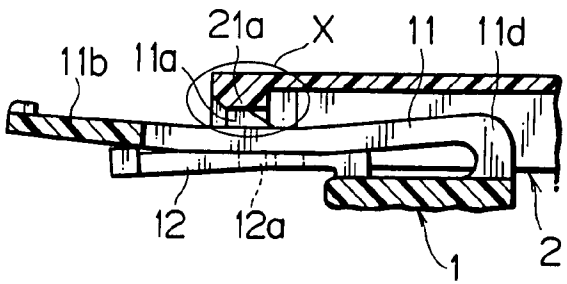
FIG. 5B is a sectional view of the male housing and female housing during connection to each other.
Figure 5A:
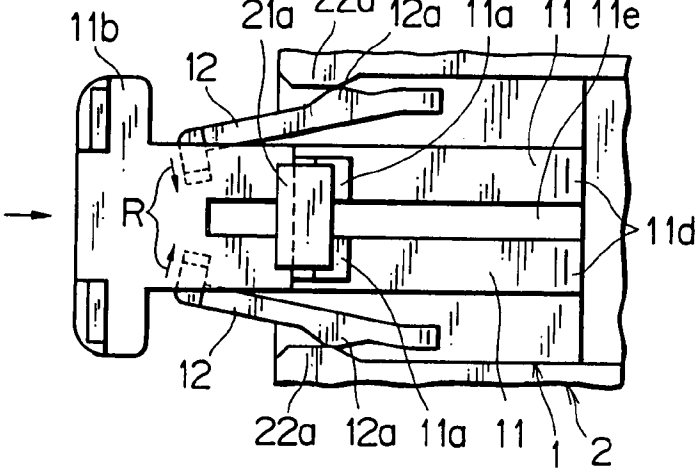
FIG. 5A is a front view of the male housing and female housing during connection to each other.

When the male housing 1 is further inserted into the female housing 2, the connection becomes as shown in FIGS. 5A and 5B. The rib protrusions 22*a* abut to the side protrusions 12*a* and deform the side locking arms 12 and push the parts thereof into between the under face of thre main locking arms 11 and the male housing 1 as shown by R in FIG. 5A. Shortly, the center protrusion 21*a* abuts to the main protrusions 11*a*. Since the parts of the side locking arms 12 are sandwiched between the main locking arms 11 and the housing 1, the main locking arms 11 are bent in a bow shape as shown in FIG. 5B. The main locking arms 11 with the cantilever structure become a center impeller structure and the main protrusions 11*a* are depressed with a large force downwardly so that a large upward repulsive force is generated and gives a suitable locking feeling.

Figure 6B:
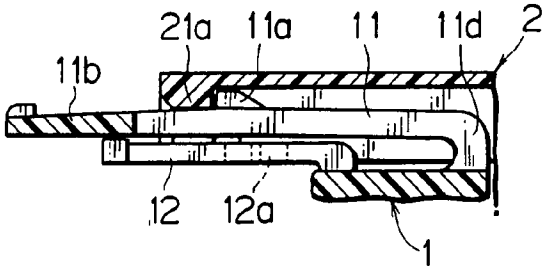
FIG. 6B is a sectional view of the male housing and female housing when they are connected to each other.
Figure 6A:
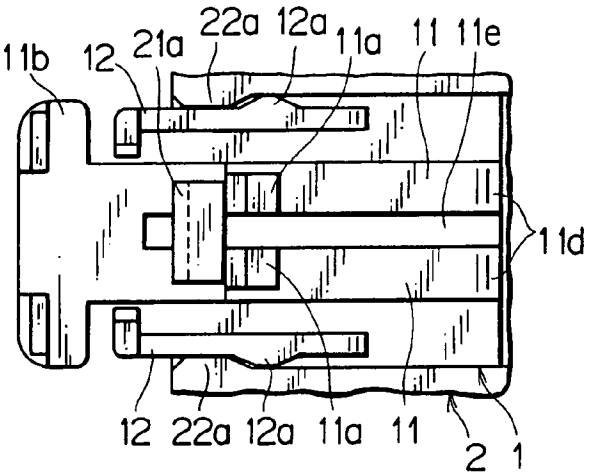
FIG. 6A is a front view of the male housing and female housing when they are connected to each other.

When the male housing 1 is further inserted into the female housing 2 from FIGS. 5A and 5B, the side protrusions 12*a* climb over the rib protrusions 22*a* and concurrently the main protrusions 11*a* climb over the center protrusion 21*a* as shown in FIGS. 6A and 6B. When the side protrusions 12*a* climb over the rib protrusions 22*a*, the entered parts of the side locking arms 12 are returned to the initial position. According with this, the main protrusions 11*a* climb over the center protrusion 21*a* and are locked with each other and the connection is completed. The electric wires connected to each the male and female housings 1 and 2 are connected electrically after completing the connection.

Figure 9:
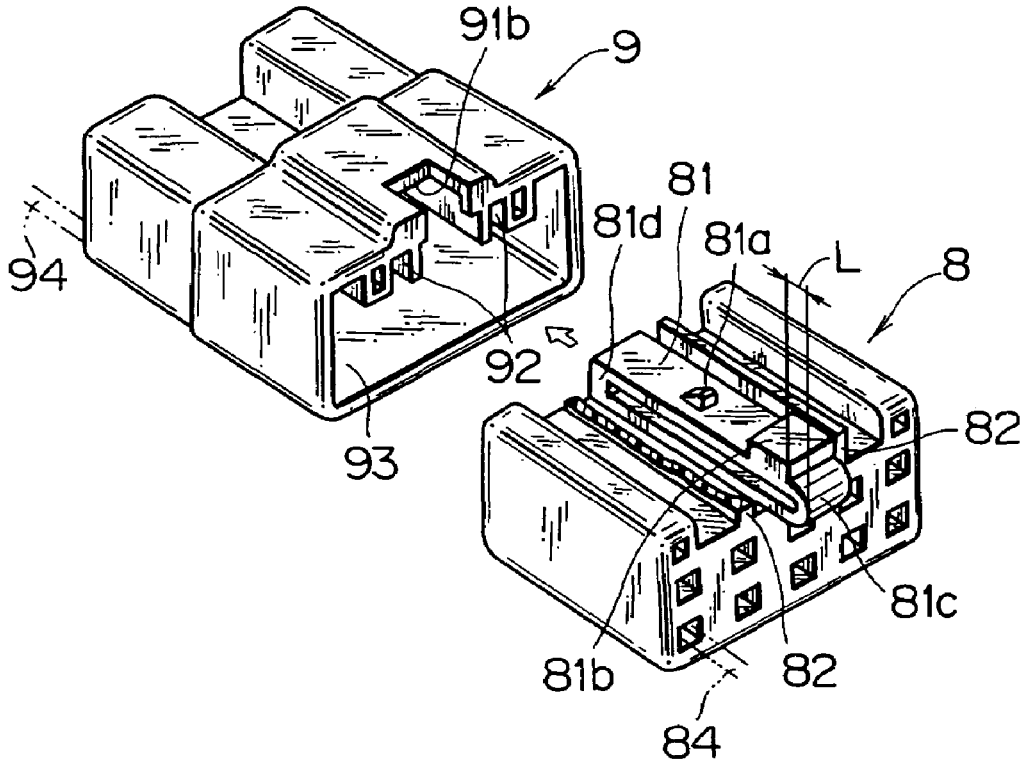
PRIOR ART F I G. 9
FIG. 9 is a perspective view showing a conventional connector.
Figure 10:
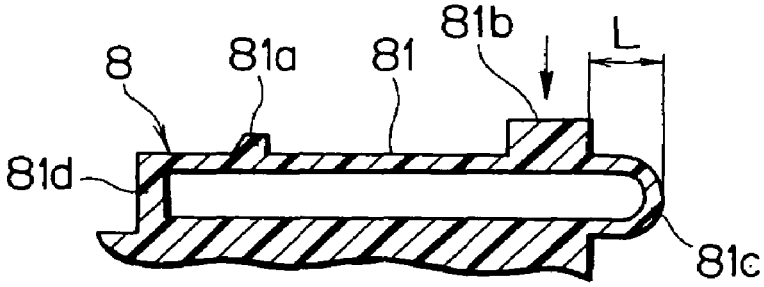
PRIOR ART F I G. 10
FIG. 10 illustrates an operation and problem of the conventional connector.

The main locking arms 11 have the cantilever structure but have a locking feeling similar to the center impeller structure. The main locking arms 11 do not extend backwardly such as the center impeller structure as shown in FIG. 9.

Figure 7B:
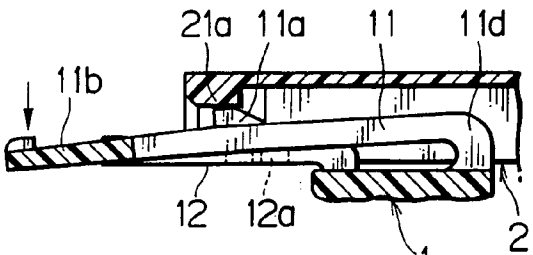
FIG. 7B is a sectional view of the male housing and female housing during disconnection from each other.
Figure 7A:
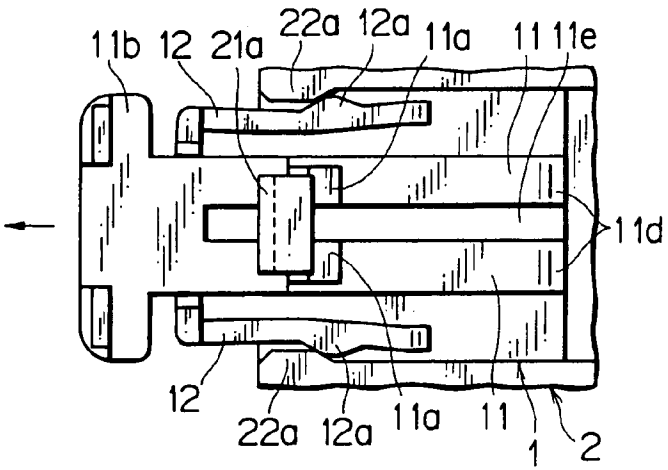
FIG. 7A is a front view of the male housing and female housing during disconnection from each other.

When the male and female housings 1 and 2 are disconnected to each other from the connecting state of FIG. 6A and 6B, it is simply to push the depressing portion 11*b* in a direction of an arrow in FIG. 7B and pull out the depressing portion 11*b* in a direction of an arrow of FIG. 7A. When the depressing portion 11*b* is depressed downwardly, the main protrusions 11*a* are unlocked from the center protrusion 21*a* without interference of the side locking arms 12, see FIG. 6A. At this state, the side locking arms 12 abut to the sides of the main locking arms 11 and do not enter underneath the main locking arms 11. Then, it is easily to pull out the male housing 1. When the depressing portion 11*b* is pulled out and the side protrusions 12*a* climb over the rib protrusions 22*a*, the side locking arms 12 are curved but do not give any difficulty for disconnecting each housing.

Accordingly, the male housing 1 and the female housing 2 are easily disconnected each other by applying a force equivalent to the cantilever structure.

According to the embodiment of the invention as described above, the connector does not have the extended portion of the main locking arm as shown in the conventional connector. The cantilever structure connector of the present invention gives the locking feeling similar to the center impeller structure connector and gives easy disconnection due to the cantilever structure.

The side locking arms 12 and the side protrusions 12*a*, and the ribs 22 and the rib protrusions 22*a* provide a stable connection of the male and female housings. They also give an easy connection and disconnection. The guide slit lie disposed at the center of the main locking arms 11 and the guide rib 21*e* disposed in the female housing 2 provide a stable connection. They also provide an easy connection and disconnection. The male and female are named expediently and do not limit the present invention.

Figure 8A:
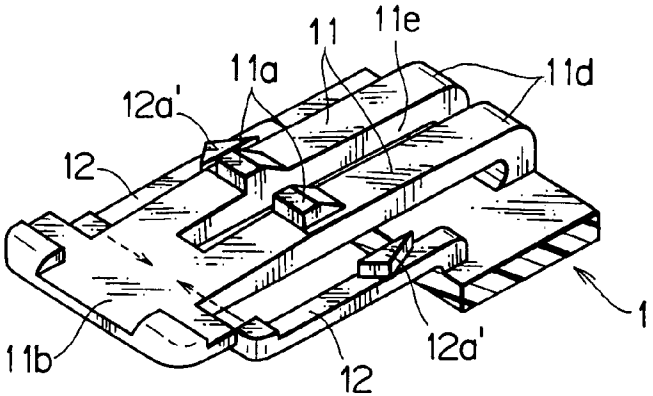
FIG. 8A is a perspective view showing a modification of the embodiment of the present invention.

As shown in FIG. 8A, side protrusions 12*a*' can be disposed on upper faces of the side locking arms 12 instead of the sides thereof.

Figure 8B:
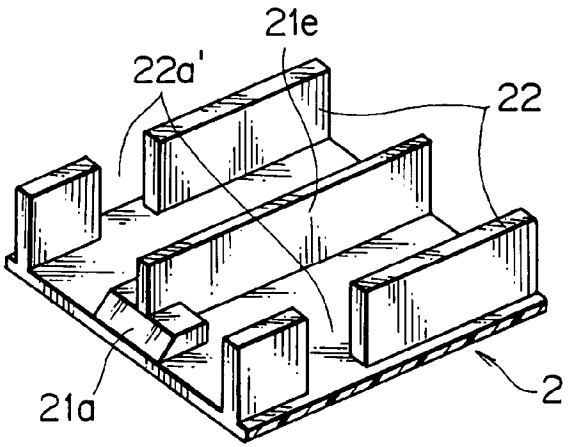
FIG. 8B is a perspective view showing a modification of the embodiment of the present invention.

Correspondingly, the rib protrusions 22*a* are modified to openings 22*a*' (rib engaging portion) as shown in FIG. 8B. The center protrusions 11*a* can be modified to grooves and correspondingly the center protrusion 21*a* is also modified. The scope of claims includes all modifications of the present invention.

What is claimed is:

1. A connector having a male housing and female housing, comprising:

a main locking arm disposed in one of the male housing and the female housing, said main locking arm having a cantilever structure and being flexible in a vertical direction;

a side locking arm disposed to a side of the main locking arm, said side locking arm having a cantilever structure and a height shorter than that of the main locking arm, and being flexible in a lateral direction to be sandwiched between the main locking arm and said one housing;

a main locking portion disposed on the main locking arm;

a side locking portion disposed on the side locking arm;

a rib upstanding in the other housing;

a rib engaging portion disposed in the rib, said rib engaging portion abutting to the side locking portion to sandwich a part of the side locking arm between the main locking arm and said one housing and lock the side locking portion after sandwiching when the male and female housings being connected to each other; and a center engaging portion disposed on a plate of the other housing, the center engaging portion abutting and pressing the main locking portion when the male and female housings are connected to each other and the part of the side locking arm is sandwiched between the main locking arm and the one housing, whereby the side locking arm can enter between a lower face of the main locking arm and the housing and limit downward bending of the main locking arm when the housings are connected to each other.

2. The connector as claimed in claim 1, wherein said center engaging portion is locked with the main locking portion at the same time when the part of the side locking arm is released from sandwiching.

3. The connector as claimed in claim 2, wherein said main locking arm has a depressing portion at an end thereof, the depressing portion disconnects locking between the main locking portion and the center engaging portion, and depresses downwardly the end of the main locking arm after disconnection while preventing the part of the side locking arm from being sandwiched between the main locking arm and said one housing.

4. The connector as claimed in claim 3, wherein said side locking arms are formed in a pair, the side locking portions are disposed at outer faces of the pair of the side locking arms, the ribs are upstanding opposedly, and the rib engaging portions extend out of inner faces of the ribs corresponding to the side locking portions.

5. A connector having a male housing and female housing, comprising:

a main locking arm disposed in one of the male housing and the female housing, the main locking arm having a cantilever structure and being flexible in a vertical direction;

a side locking arm disposed to a side of the main locking arm, having a cantilever structure and a height shorter than that of the main locking arm, the side locking arm being flexible in a lateral direction; and a rib upstanding in the other housing, whereby, when the male and female housings are connected to each other, the side locking arm contacts with the rib and allows a part of the side locking arm to be sandwiched between a lower face of the main locking arm and said one housing and limit downward bending at the main locking arm, and a part of the main locking arm contacts with the other housing so that the main locking arm is depressed.

6. A connector having a male housing and female housing, comprising:

a main locking arm disposed in one of the male housing and the female housing, said main locking arm having a cantilever structure and being flexible in a vertical direction;

side locking arms disposed to a side of the main locking arm, said side locking arms being flexible in a lateral direction to be sandwiched between the main locking arm and said one housing;

a main locking portion disposed on the main locking arm;

a side locking portion disposed on each side locking arm;

a rib upstanding in the other housing;

a rib engaging portion disposed in the rib, said rib engaging portion abutting to the side locking portion to sandwich a part of the side locking arms between the main locking arm and said one housing and lock the side locking portion after sandwiching when the male and female housings being connected to each other; and a center engaging portion disposed on a plate of the other housing, the center engaging portion abutting and pressing the main locking portion when the male and female housings are connected to each other and the part of the side locking arms is sandwiched between the main locking arm and the one housing; wherein:

said center engaging portion is locked with the main locking portion at the same time when the part of the side locking arm is released from sandwiching, said main locking arm has a depressing portion at an end thereof, the depressing portion disconnects locking between the main locking portion and the center engaging portion, and depresses downwardly the end of the main locking arm after disconnection while preventing the part of the side locking arms from being sandwiched between the main locking arm and said one housing, said side locking arms are formed in a pair, the side locking portions are disposed at outer faces of the pair of the side locking arms, the ribs are upstanding opposedly, and the rib engaging portions extend out of inner faces of the ribs corresponding to the side locking portions, and wherein said main locking arm has a guide slit in a longitudinal direction thereof, and the other housing has an upstanding guide rib corresponding to the guide slit.

* * * * *